US006915102B2

(12) United States Patent
Aoki et al.

(10) Patent No.: US 6,915,102 B2
(45) Date of Patent: Jul. 5, 2005

(54) ORIGINAL DOCUMENT CONVEYANCE DEVICE

(75) Inventors: Masashi Aoki, Hachioji (JP); Tsuyoshi Mizubata, Hachioji (JP); Kiyoshi Hata, Hachioji (JP); Satoru Shimizu, Hachioji (JP)

(73) Assignee: Konica Minolta Business Technologies, Inc., (JP)

( * ) Notice: Subject to any disclaimer, the term of this patent is extended or adjusted under 35 U.S.C. 154(b) by 0 days.

(21) Appl. No.: 10/828,796

(22) Filed: Apr. 21, 2004

(65) Prior Publication Data

US 2005/0058477 A1 Mar. 17, 2005

(30) Foreign Application Priority Data

Sep. 17, 2003 (JP) ..... 2003-324225

(51) Int. Cl.[7] ..... G03G 15/00
(52) U.S. Cl. ..... 399/367; 399/374
(58) Field of Search ..... 399/367–374, 399/365, 364, 361; 271/110, 902, 291, 3.13

(56) References Cited

U.S. PATENT DOCUMENTS 4,143,960 A * 3/1979 Tracy ..... 399/372
4,469,436 A * 9/1984 Jones et al. ..... 355/51
5,022,639 A * 6/1991 DuBois ..... 271/3.2
6,256,473 B1 * 7/2001 Kamanuma et al. ..... 399/367
6,285,852 B1 * 9/2001 Etoh et al. ..... 399/367
6,321,064 B1 * 11/2001 Mizubata et al. ..... 399/370
6,381,439 B2 * 4/2002 Hirota et al. ..... 399/374

FOREIGN PATENT DOCUMENTS

JP 6-227696 8/1994

OTHER PUBLICATIONS

English Abstract of JP 6-227696.

* cited by examiner

*Primary Examiner*—Anthony H. Nguyen
(74) *Attorney, Agent, or Firm*—Cantor Colburn LLP

(57) ABSTRACT

A document sheet conveyance device includes a sheet feeding tray on which document sheets are stacked, a stopping member against which leading edges of the stacked document sheets hit, a sheet feeding member for feeding the document sheets in the order from a top thereof, a separation member for separating a sheet from the fed document sheets and feeding, a stopper provided between the sheet feeding member and the separation member, for preventing the document sheet from moving toward the separation member, a switching member provided downstream of the separation member, for switching a conveyance path of the document sheet, a working member for enabling the stopper to move from a sheet stop position to a sheet releasing position, an interlocking member for moving the working member when the switching member is operated, and a drive member for driving the working member.

3 Claims, 2 Drawing Sheets

ORIGINAL DOCUMENT CONVEYANCE DEVICE

BACKGROUND OF THE INVENTION

The present invention relates to an original document conveyance device by which the original document is conveyed to a reading position for image reading.

A basic structure of the original document conveyance device is composed of a sheet feed tray on which original documents are stacked, a conveyance means by which the original document is conveyed from the sheet feed tray and passed the reading position, and a delivery sheet tray on which the original document passed the reading position is stacked.

In a sheet feed section to feed the original document from the sheet feed tray, there are provided, generally, a feeding means for feeding the original document in the order from the top, and a separation and conveyance means by which the fed original documents are separated to one sheet and conveyed, further, there is provided a stopping member by which ends of the original documents in front of a feed direction are made uniform and the smooth feeding is enabled, and the original document is assuredly conveyed one by one sheet.

For example, in Japanese Tokkaihei 6-227696, original document stop members 1 and 101 as a stopping member are provided in front of the feeding direction of a sheet feed roller 9 as a feeding means.

In Japanese Tokkaihei 6-227696, further, a movable stopper 2 is provided, and made so that the original document is not set going over the leading edge position. Then, it is structured in such a manner that the stopper 2 is retreated when the original document conveyance is started.

The structure in which the stopper is provided in addition to the stopping member as in Japanese Tokkaihei 6-227696, is a means by which the original document is surely conveyed one by one, and which is effective in a control of a conveyance timing or in a posture control of the conveyed original document, and the high speed reading can be conducted, however, there are problems that a mechanism becomes complicated in such a case where a drive means for driving the stopper is provided, and a cost is increased.

Further, because an operation of the stopper relates to a timing control, it is necessary to make the synchronization with the control of other parts in the original document conveyance device. Therefore, when the synchronization control is not normally conducted, the conveyance failure such as a jam is generated.

SUMMARY OF THE INVENTION

The object of the present invention is to actuate the stopper for stopping the leading edge of the original document, and to solve a problem in a cost or a problem in the control.

The object is attained by any one of following Structures 1–3.

Structure 1: In an original document conveyance device having a sheet feed tray on which the original documents are stacked, a stopping member with which a leading edge in the conveyance direction of the stacked original documents is brought into contact, a feeding means for feeding the stacked original documents in the order from the top, a separation and conveyance means for separating the fed original documents into one sheet and for conveying it, a stopper which is arranged between the feeding means and the separation and conveyance means, and which obstructs the movement of the original document to the separation and conveyance means, and a switching guide means which is arranged downstream of the separation and conveyance means, and which switches the conveyance paths of the original document. The original document conveyance device is characterized in that it has a working member by which the stopper can be retreated from the stop position to obstruct the movement of the original document, an interlock means by which the switching guide means is switched when the working member is operated, and a drive means for driving the working member.

Structure 2: The original document conveyance device according to Structure 1, wherein it has a registration roller, which is arranged downstream of the separation and conveyance means and arranged upstream of the switching guide means, and which controls the running of the original document.

Structure 3: The original document conveyance device according to Structures 1 or 2, wherein it has a conveyance path for a single-sided reading and a conveyance path for a double-sided reading, and the switching guide means is a means for switching the original document to the conveyance path for the single-sided reading or the conveyance path for the double-sided reading, and for guiding the original document.

DETAILED DESCRIPTION OF THE PREFERRED EMBODIMENT

Figure 1:
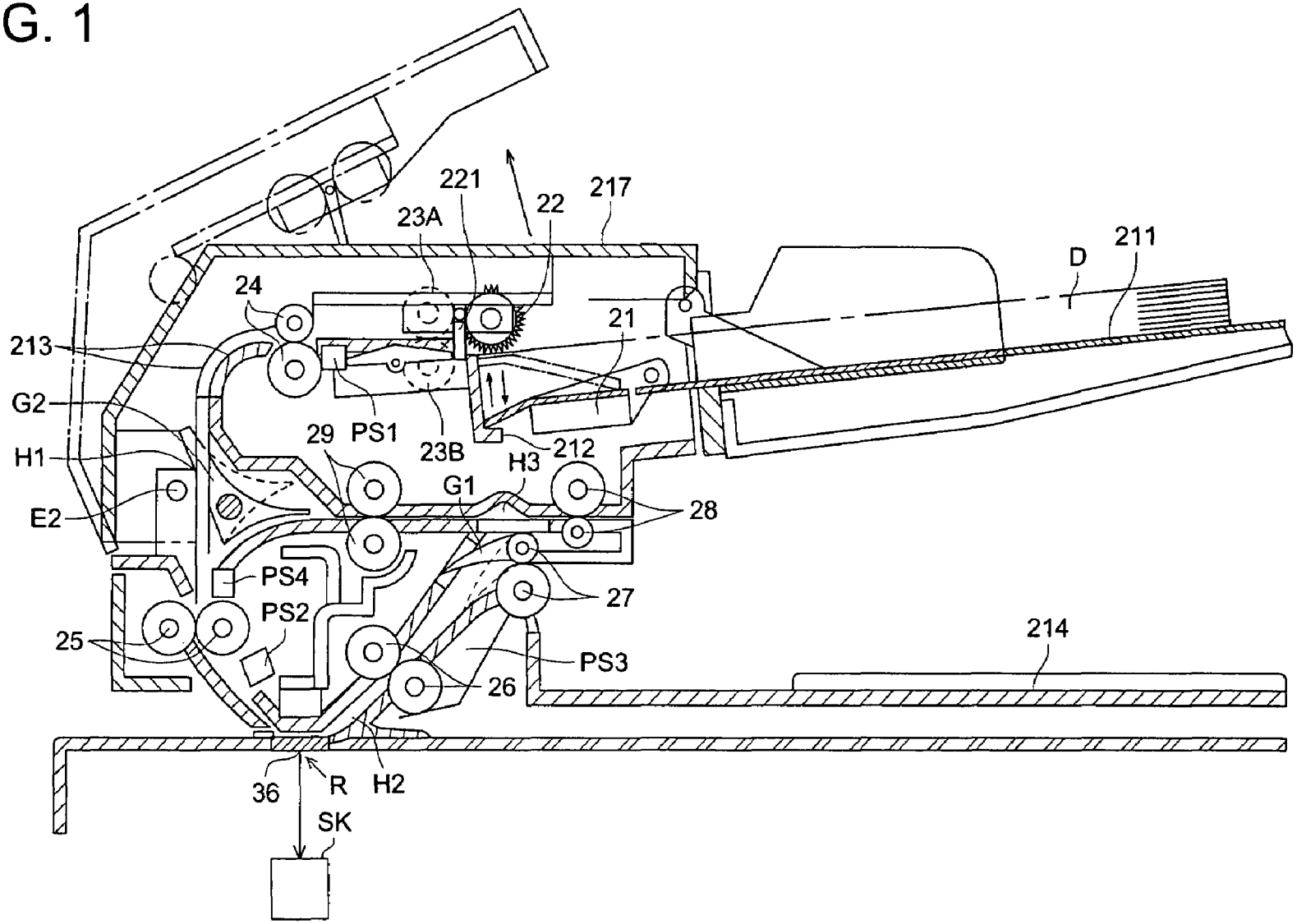
FIG. 1 is a sectional view of an example of an image original document conveyance device according to an embodiment of the present invention.

Referring to FIG. 1, the structure and operation of an example of an original document conveyance device according to an embodiment of the present invention will be explained below. FIG. 1 is a sectional view of an example of the original document conveyance device according to an embodiment of the present invention.

Initially, an operation of the original document conveyance device in the single-sided reading will be explained.

The original document D is placed on the sheet feed tray 211 of the original document conveyance device. A stopping member 212 is provided at a forward position in the original document feeding direction of the sheet feed tray 211, and when the leading edge of the original document D is brought into contact with this stopping member 212, the original documents D are aligned and stacked. Stacked original documents D are pressed toward a feed roller 22 as a feed means by an original document pressing plate 21, and by a rotation of the feed roller 22, the original document D is fed in the order from the top. The fed original documents D are separated into one sheet and conveyed by a conveyance roller 23A and a separation roller 23B, which structure a separation and conveyance means. A stopper 221 is provided between the feed roller 22 and conveyance roller 23A, and the movement of the original document D to the conveyance roller 23A is obstructed up to the start of the original document feed. Hereupon, the operation of the stopper 221 will be explained later.

Simultaneously with the start of the conveyance roller 23A, obstruction of the stopper 221 is released, and the original document D can be moved from the conveyance roller 23A to the downstream side. The original document D conveyed by the conveyance roller 23A is brought into contact with a registration roller 24, and its leading edge is stopped.

After the leading edge of the original document D is temporarily stopped by the registration roller 24, the registration roller 24 is started and conveys the original document D, however, by this temporary stop, the leading edges of the original document D are aligned. The registration roller 24 controls the conveyance timing and the skew of the original document D and conveys it.

The registration roller 24 is controlled and started by a leading edge detection signal of the original document sensor PS1.

The original document D conveyed by rotation of the registration roller 24, is advanced on a conveyance path H1 for a single-sided reading formed of a guide member 213, and further, conveyed by the conveyance roller 25 and runs on a conveyance path H2 for reading, and passes a reading position R at which a slit glass 36 is provided.

The image reading by a reading means SK is conducted on the original document D that passes the reading position R.

An original document sensor PS2 provided facing the conveyance path H2 for reading immediately before the reading position R, generates a signal for synchronous control of the image reading with, for example, another operation such as the image writing.

The original document D passed the reading position R is delivered on a delivery sheet tray 214 through the conveyance roller 26, gate G1, and delivery sheet roller 27.

Hereupon, in the single-sided reading, the gates G1, G2 as the switching guide means are set at positions shown by a solid line.

Next, the double-sided reading will be explained.

The original document D which is fed by the feed roller 22 in the same manner as in the single-sided reading, and separated into one sheet and conveyed by the conveyance roller 23A and separation roller 23B, is conveyed by the registration roller 24.

Figure 3:
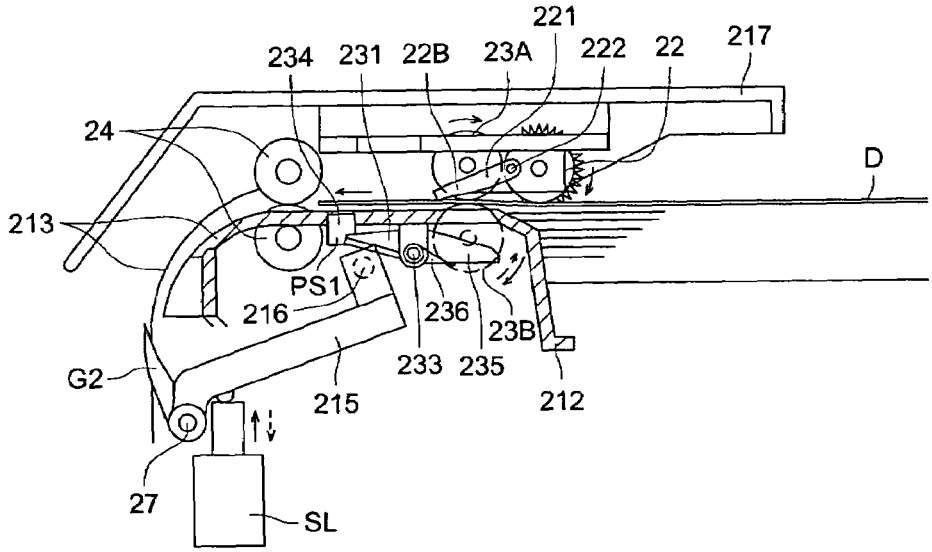
FIG. 3 is an enlarged sectional view of a sheet feed section.

In the double-side reading, the gate G2 as the switching guide means is set at a position shown in FIG. 3, that is, an upward protruded portion of the gate G2 is set at a position of clock short hand of almost 11 o'clock. Hereupon, this operation of the gate G2 will be explained later.

The original document D conveyed by the resister roller 24 is guided by the gate G2, and guided to a conveyance path H3 for double-sided reading on which reversal conveyance rollers 28, 29 are arranged.

The original document D is conveyed in the right direction by the reversal conveyance rollers 28, 29, however, under the condition that its trailing edge is nipped by the reversal conveyance roller 28, the reversal conveyance rollers 28, 29 reverses the conveyance direction, and the original document D is conveyed in the left direction.

The original document D is, further, conveyed by the conveyance roller 25, and passes the reading position R.

Because the front and rear sides of the original document D are reversed by the reversal conveyance by the reversal conveyance rollers 28, 29, the rear-sided reading is conducted at the reading position R.

The original document D passed the reading position R is guided by the gate G1 set at the dotted line position, through the conveyance roller 26, and conveyed to the reversal conveyance roller 28.

In the same manner as described above, after the reversal conveyance roller 28 conveys the original document in the right direction, it reverses the conveyance direction under the condition that the trailing edge of the original document is nipped, and conveys the original document D in the left direction.

The original document D conveyed in the left direction by the reversal conveyance roller 28 is conveyed by the reversal conveyance roller 29 and the conveyance roller 25, and passes again the reading position R. At the time of this re-passing through, the reading of the front side image of the original document is conducted.

The original document D passed the reading position R is conveyed by the conveyance roller 26, and guided by the gate G1 set at the solid line position, and conveyed by the delivery sheet roller 27, and delivered on the delivery sheet tray 214. On the delivery sheet tray 214, the original document D is stacked under the condition that the front side faces downward.

Hereupon, in the conveyance process in the case where the double-sided reading is continuously conducted on a plurality of original documents, when the succeeding original document D is conveyed while the preceding document D is conveyed, the reading efficiency is increased.

That is, according to OFF signal of an original document sensor PS4 (original document sensor provided at the exit of the conveyance path H3 for double-sided reading) by the trailing edge pass of the original document D after the front side reading, the original document conveyance from the feeding to the conveyance by the registration roller 24 is started. Such a conveyance control is conducted without any trouble in the case where, only when the leading edge portion of the original document D is conveyed, the original document D is nipped by the reversal conveyance rollers 28, 29, and when the original document D is arrived at the next conveyance roller 25 and shifted to the conveyance thereby, the nip by the reversal conveyance rollers 28, 29, is released.

Above the original document conveyance device, a cover 217 which is pivoted by an axis E2 provided on the main body frame and can be opened and closed, is provided, the feed roller 22, conveyance roller 23A and stopper 221 are supported by the cover 217. When the cover 217 is rotated around the axis E2 and opened, as shown by a chain line, the feed roller 22, conveyance roller 23A and stopper 221 are rotated and the original document conveyance path formed of the guide member 213 can be opened.

(Operation of the Stopper 221)

The stopper 221 actuates, during the operation by which the original documents D are stacked on the sheet feed tray 211, on a working position to obstacle that the original document D enters into the separation and conveyance means, and on a retreat position by which, when the conveyance is started, the original document can be passed.

Figure 2:
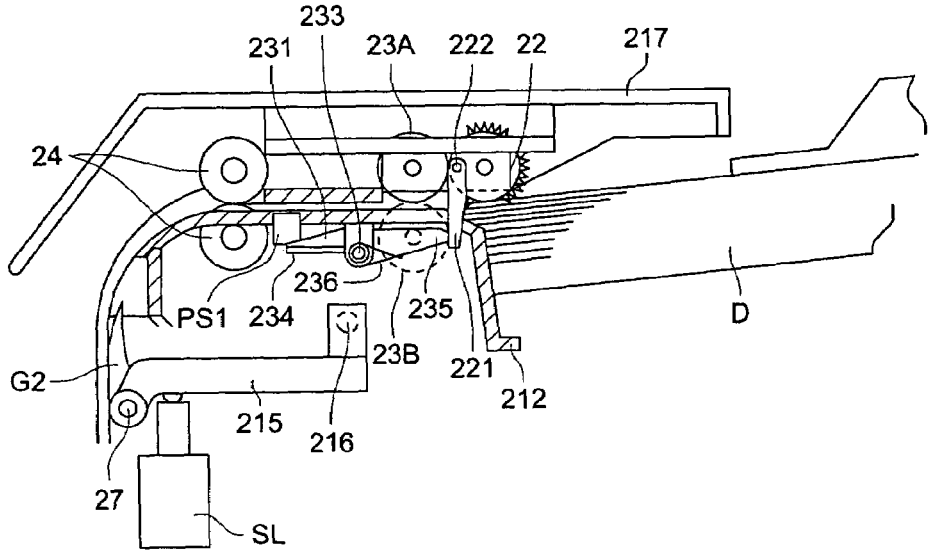
FIG. 2 is an enlarged sectional view of a sheet feed section.

Referring to FIGS. 2 and 3, such an operation of the stopper 221 will be described below. FIGS. 2 and 3 are enlarged sectional views of the sheet feed section.

In the standby situation in FIG. 2, the stopper 221 can rotate around a fulcrum 222, and is engaged with the right end portion 235 of a working member 231 supported by a fulcrum 233 so that it can be rotated, and the clockwise rotation is obstructed. The working member 231 is forced counterclockwise by a spring 236, and held at a position in FIG. 2 by the stopper that is not shown.

Simultaneously when the feed roller 22 and conveyance roller 23A are started by the start signal of the original document conveyance, a solenoid SL as the drive means is operated.

By the operation of the solenoid SL, a lever 215 as an interlock means is rotated counterclockwise around the fulcrum 27. Because the lever 215 is integrated with the gate G2, and acts on the left end portion 234 of the working member 231 at a working point 216 provided at its right end, by the operation of the solenoid SL, the working member 231 is rotated clockwise through the lever 215, and the engagement of the stopper 221 is released. By this release operation, the stopper 221 becomes free, and is pushed by the conveyed original document D and, as shown in FIG. 3, becomes a situation of the clock short hand of 8 o'clock. That is, the original document D runs from the feed roller 22 to the conveyance roller 23A, and by the separation roller 23B, the documents D are separated into one sheet.

In the single-sided reading, by a leading edge detection signal of the original document sensor PS1 (shown in FIG. 1), the solenoid SL turns OFF. By OFF of the solenoid SL, the gate G2 and lever 215 are rotated clockwise, and return from FIG. 3 to the situation of FIG. 2. Accordingly, the original document D conveyed by the registration roller 24 runs not to the conveyance path H3 for double-sided reading, but to the conveyance path H1 for single-sided reading. Hereupon, the stopper 221 is maintained in the situation of FIG. 3 while the original document D passes.

When the reading is completed, by the original document trailing edge detection signal of an original document sensor PS3 (shown in FIG. 1) provided in the delivery sheet section, the solenoid SL turns OFF after it turns ON for a predetermined time. By this ON and OFF operation, because the working member 231 is engaged again with the stopper 221 after its right end portion 235 is separated from the stopper 221 once, the stopper 221 is reset to the position of FIG. 2 when the reading is completed.

The original document conveyance of the downstream from the registration roller 24 is conducted on the basis of the leading edge detection signal of the original document sensor PS1, however, because the stopper 221 arranged on the upstream side of the registration roller 24 and the gate G1 arranged on the downstream side of the registration roller 24 are mechanically interlocked, the control of the upstream side and the control of the downstream side are always conducted with the assured synchronous relationship.

In the double-sided reading, in the same manner as in the case of the single-sided reading, by the original document conveyance start signal, the solenoid SL turns ON and the engagement of the stopper 221 is released, and the original document conveyance is started, however, until the original document D is conveyed by the registration roller 24 and its reading edge passes the gate G2, the solenoid SL continues ON. Accordingly, under the condition that the gate G2 is set to the situation of FIG. 3, the original document is conveyed by the registration roller 24. Hereby, the original document D is guided by the gate G2, and runs to the conveyance path H3 for double-sided reading. After a predetermined time passes from the original document trailing edge detection signal of the original document sensor PS1, the solenoid SL turns OFF.

The operation of the solenoid SL at the time of reading completion and the return operation of the stopper 221 are the same as in the case of the single-sided reading described above.

According to any one of Structures 1–3, the original document conveyance device by which the original document conveyance to separate the original documents one by one sheet from the original documents stacked on the sheet feed tray, and to convey it, is surely conducted, can be produced at low cost, and the conveyance control to separate original documents into one sheet and to convey it, and the guide control of the original document in other conveyance sections in the original document conveyance device, are surely conducted.

According to Structure 2, the conveyance control in the upstream of the registration roller and that in the downstream are surely conducted without any confusion.

According to Structure 3, the conveyance of the original document in the double-sided reading is surely conducted.

What is claimed is:

1. An original document sheet conveyance device comprising:

(a) a sheet feeding tray on which document sheets are stacked;

(b) a stopping member against which leading edges of the stacked document sheets in a conveyance direction thereof hit;

(c) a sheet feeding member for feeding the document sheets in the order from a top thereof;

(d) a separation and conveyance member for separating a single sheet from the fed document sheets and feeding the separated sheet;

(e) a stopper provided between the sheet feeding member and the separation and conveyance member, for preventing the document sheet from moving toward the separation and conveyance member;

(f) a switching member provided downstream of the separation and conveyance member, for switching a conveyance path of the document sheet;

(g) a working member for enabling the stopper to move from a stop position at which the document sheet is prevented from advancing to a retreat position at which the document sheet advances;

(h) an interlocking member for moving the working member when the switching member is operated; and (i) a drive member for driving the working member.

2. The document sheet conveyance device of claim 1, further comprising a registration roller provided downstream of the separation and conveyance member and upstream of the switching member, for controlling movement of the document sheet.

3. The document sheet conveyance device of claim 1, further comprising a first conveyance path for a one-sided reading and a second conveyance path for a two-sided reading, wherein the switching member switches the document sheet between the first and second conveyance path to guide the document sheet.

* * * * *